US005826799A

United States Patent [19]

Hsieh

[11] Patent Number: 5,826,799

[45] Date of Patent: Oct. 27, 1998

[54] SPRINKLING HEAD STRUCTURE

[76] Inventor: Paul Hsieh, No. 78, Lane 234, Sec. 3, Chang-Nan Road, Chang-Hua City, Taiwan

[21] Appl. No.: 758,363

[22] Filed: Dec. 3, 1996

[51] Int. Cl.[6] ..... B05B 1/30; E03C 1/08

[52] U.S. Cl. ..... 239/428.5; 239/589

[58] Field of Search ..... 239/428.5, 429, 239/430, 569, 589, 590

[56] References Cited

U.S. PATENT DOCUMENTS

| | | | |
|---|---|---|---|
| 2,989,249 | 6/1961 | Richter | 239/589 X |
| 4,542,853 | 9/1985 | Diamond | 239/428.5 X |
| 4,561,593 | 12/1985 | Cammack et al. | 239/590 X |
| 4,573,639 | 3/1986 | Logue | 239/428.5 |
| 5,111,994 | 5/1992 | Gonzalez | 239/428.5 |
| 5,154,355 | 10/1992 | Gonzalez | 239/428.5 |

*Primary Examiner*—Andres Kashnikow
*Assistant Examiner*—Robin O. Evans
*Attorney, Agent, or Firm*—Morton J. Rosenberg; David I. Klein; Jun Y. Lee

[57] ABSTRACT

A sprinkling head structure including a housing, a valve seat, a water valve, a cap member and a ball joint. The valve seat is disposed in the housing, whereby an air chamber is defined between the valve seat and the housing. The water valve is disposed in the valve seat and communicated with a trumpet-shaped water discharging passage of the valve seat. The valve seat is formed with through holes communicating the air chamber with the water discharging passage. When a liquid flows from the water valve to the water discharging passage, an instantaneous low pressure is created, whereby the air is sucked in through the air vents from the air chamber to impact and interrupt the liquid so that the air is mixed with the liquid to form an intermittent bead-like water beam for achieving a massaging effect.

6 Claims, 8 Drawing Sheets

SPRINKLING HEAD STRUCTURE

BACKGROUND OF THE INVENTION

The present invention relates to a sprinkling head structure in which a liquid quickly passes through a trumpet-shaped water discharging passage to suck air thereinto. The air is mixed with the liquid to form intermittent bead-like water beam.

FIG. 1 shows a conventional sprinkling head one end of which is connected with a water hose and the other end of which is formed with multiple orifices. The water can pass through the orifices to be sprinkled out as slender water beams. However, in the case of great water pressure, the slender water beams quickly impact a human skin by a relatively small contacting area. This often leads to uncomfortable painful feeling. In the case of small water pressure, the slender water beams will be over-scattered with less amount of discharged water. This makes it difficult to fully clean up the human body.

SUMMARY OF THE INVENTION

To obviate the above problems, it is a primary object of the present invention to provide a sprinkling head structure in which a liquid quickly passes through a trumpet-shaped water discharging passage to suck air thereinto. The air is mixed with the liquid to form intermittent bead-like water beams and increase the contacting area between the water beams and the skin. The bead-like water beams intermittently impact the skin to achieve a massaging effect.

It is a further object of the present invention to provide the above sprinkling head structure in which the distance between the through holes of the valve seat for guiding air and the air vents for sucking the air into the water discharging passage is shortened so that the time for the air to pass through the air chamber between the valve seat and the housing is reduced for avoiding resonant echo.

The present invention can be best understood through the following description and accompanying drawing, wherein:

DETAILED DESCRIPTION OF THE PREFERRED EMBODIMENTS

Figure 1:
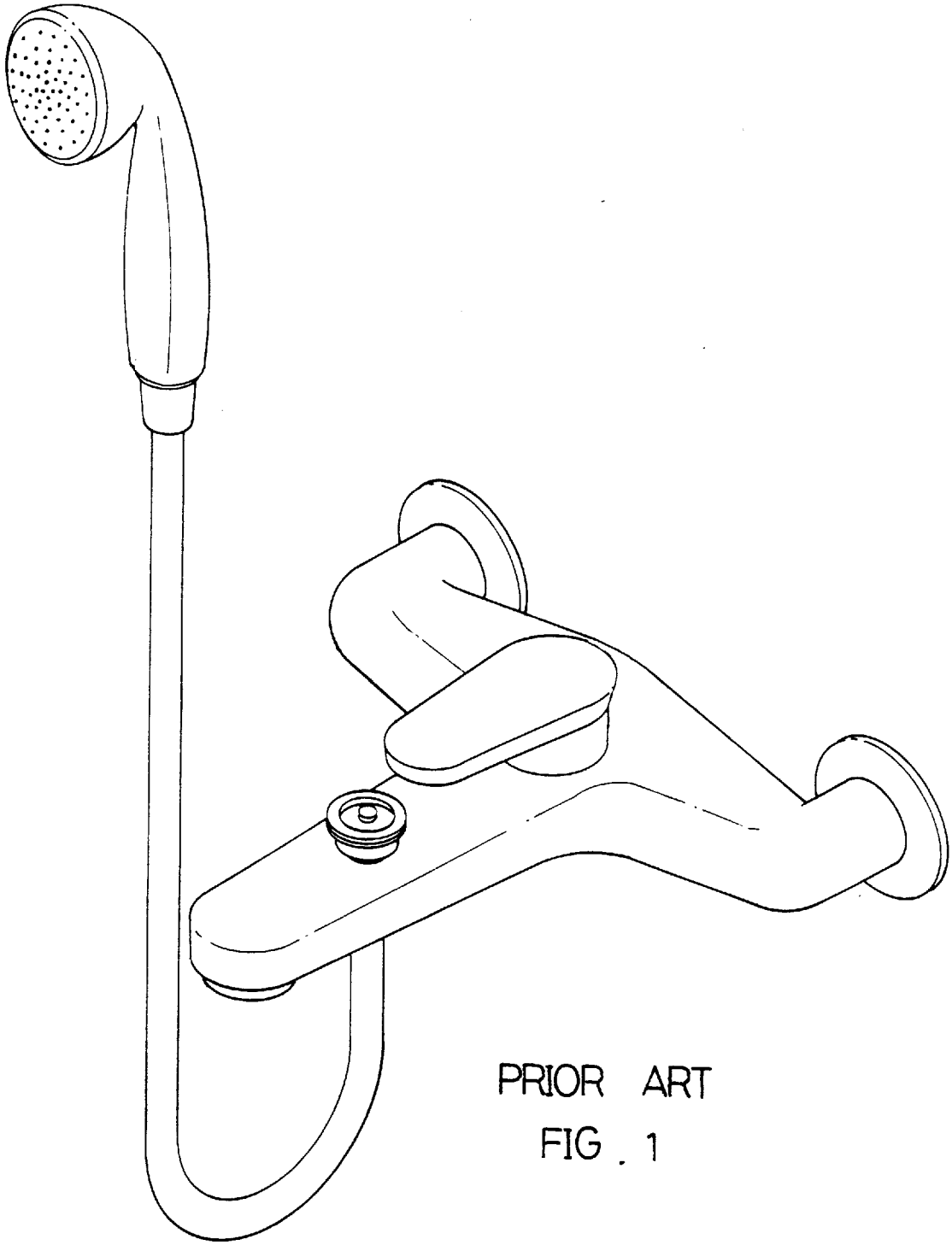
PRIOR ART FIG. 1
FIG. 1 is a perspective view of a conventional sprinkling head.
Figure 2:
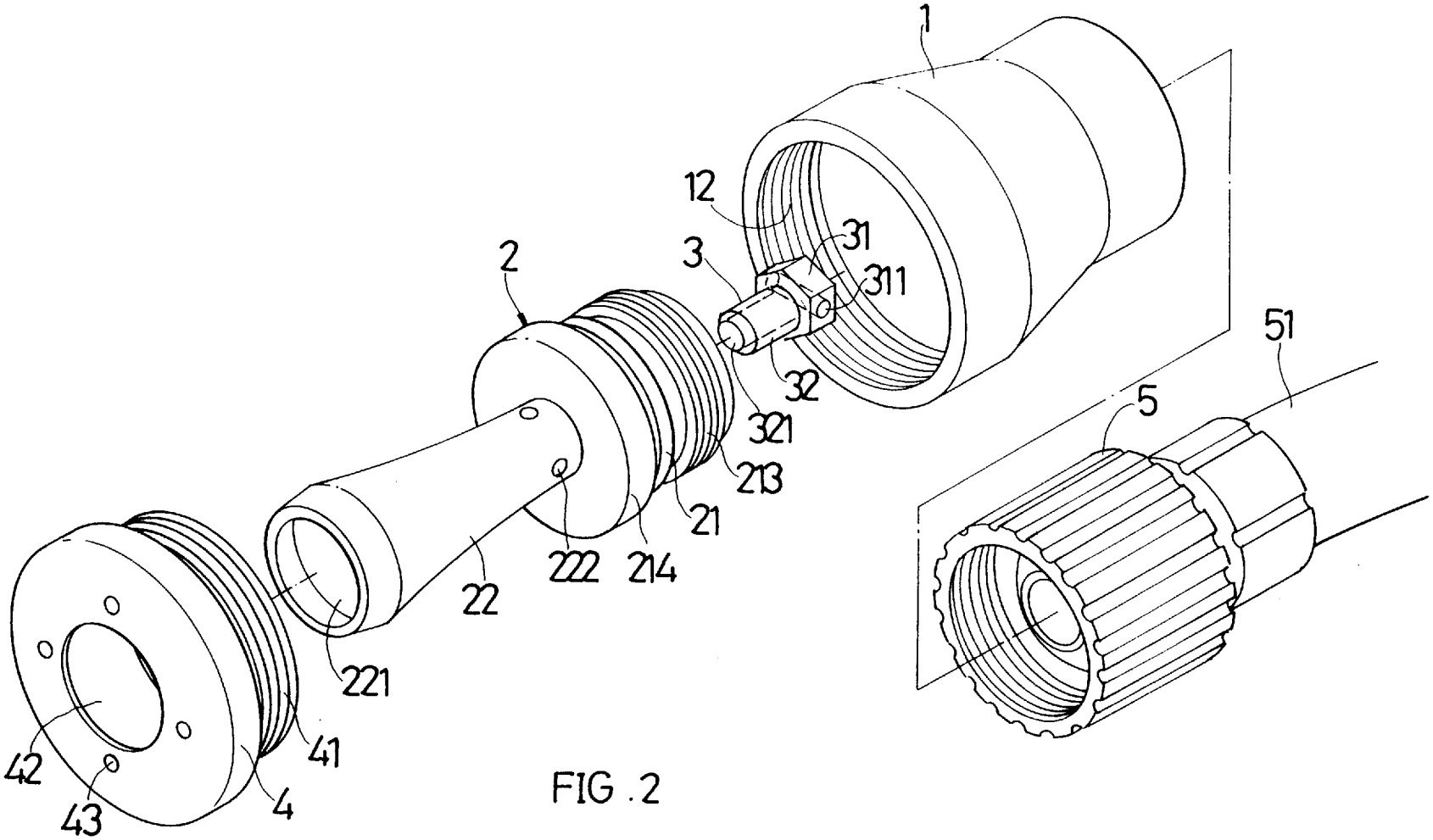
FIG. 2 is a perspective exploded view of a first embodiment of the present invention.
Figure 3:
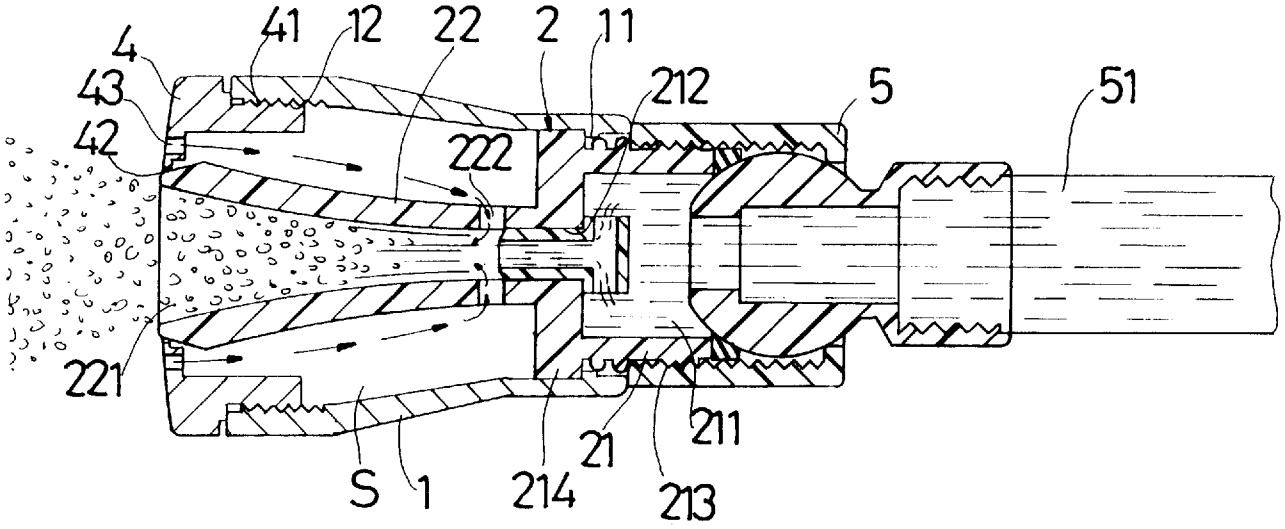
FIG. 3 is a sectional assembled view of the first embodiment of FIG. 2.

Please refer to FIGS. 2 and 3. The sprinkling head of a first embodiment of the present invention includes a housing 1, a valve seat 2, a water valve 3, a cap member 4 and a ball joint 5.

The housing 1 is hollow, having a first and a second open ends. The first end is disposed with an inward extending flange 11, while the second end is disposed with inner thread 12.

The valve seat 2 is located in the housing 1 and disposed with a connecting section 21 abutting against the flange 11 and extending into the first end of the housing 1. The connecting section 21 is formed with an opening 211. The valve seat 2 is further disposed with a spout section 22 axially extending from the connecting section 21. An air chamber S is defined between the spout section 22 and the housing 1. The spout section 22 is formed with a trumpet-shaped water discharging passage 221 gradually expanded from the connecting section 21. The water discharging passage 221 is communicated with the opening 211 through the shaft hole 212 of the connecting section 21. The spout section 22 is disposed with air vents 222 communicating the air chamber S with the water discharging passage 221. The connecting section 21 is formed with outer thread 213 and an annular stopper section 214 abutting against the flange 11 of the housing 1 to avoid detachment.

The water valve 3 is disposed in the shaft hole 212 of the connecting section 21, having a large diameter section 31 and a small diameter section 32 fitted in the shaft hole 212 of the connecting section 21. The large diameter section 31 is positioned in the opening 211 to abut against an end face of the shaft hole 212. The large diameter section 31 is formed with radial tunnel 311 communicated with an axial passage 321 of the small diameter section 32. The radial tunnel 311 and the axial passage 321 are communicated with the water discharging passage 221 of the spout section 22.

The cap member 4 is formed with outer thread 41 screwed in the inner thread 12 of the second end of the housing 1 so as to secure the valve seat 2 in the housing 1. The cap member 4 is formed with an axial opening 42 through which the spout section 22 protrudes outside. In addition, the end face of the cap member 4 is formed with multiple through holes 43 for communicating the air chamber S and ambient atmosphere.

Figure 5:
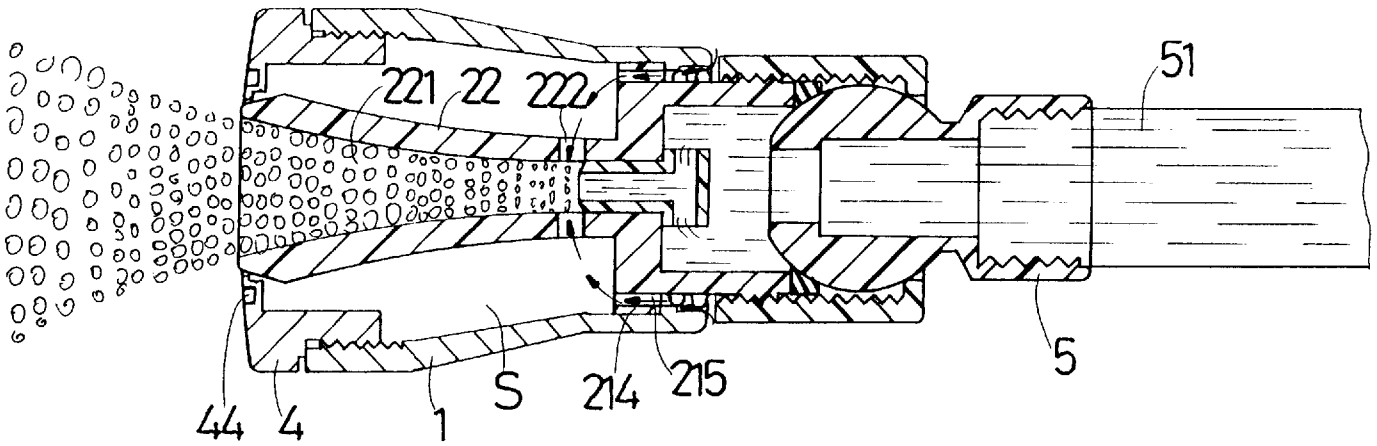
FIG. 5 is a sectional assembled view of the second embodiment of FIG. 4.

The connecting section 21 of the valve seat 2 is connected with the ball joint 5 via the outer thread 213. The ball joint 5 is connected with a water hose 51 or fixed on a wall surface (not shown). Referring to FIG. 5, when a liquid flows in from the ball joint 5, the liquid will go into the opening 211 of the connecting section 21 of the valve seat 2 and flow through the radial tunnel 311 and axial passage 321 of the water valve 3 into the water discharging passage 221. Due to the trumpet profile of the water discharging passage 221, when the liquid passes through the radial tunnel 311 and axial passage 321 with higher pressure into the water discharging passage 221, the liquid will have a very slow flowing speed. However, when the liquid gradually enter the larger passage, the pressure is relieved and the flowing speed is quickened. Therefore, when the liquid quickly passes through the axial passage 321, an instantaneous low pressure is created, whereby the air is sucked in from the air chamber S and the air chamber S is continuously supplemented with air through the through holes 43 of the cap member 4. Therefore, when the air goes into the water discharging passage 221 in a discontinuous state, the liquid is stricken and interrupted so that the air is mixed with the liquid to form an intermittent bead-like water beam with interlaced liquid sections and air sections. The water beam has larger cross-section, whereby when impacting a human skin, a larger area is intermittently depressed so as to achieve a comfortable massaging effect.

Figure 4:
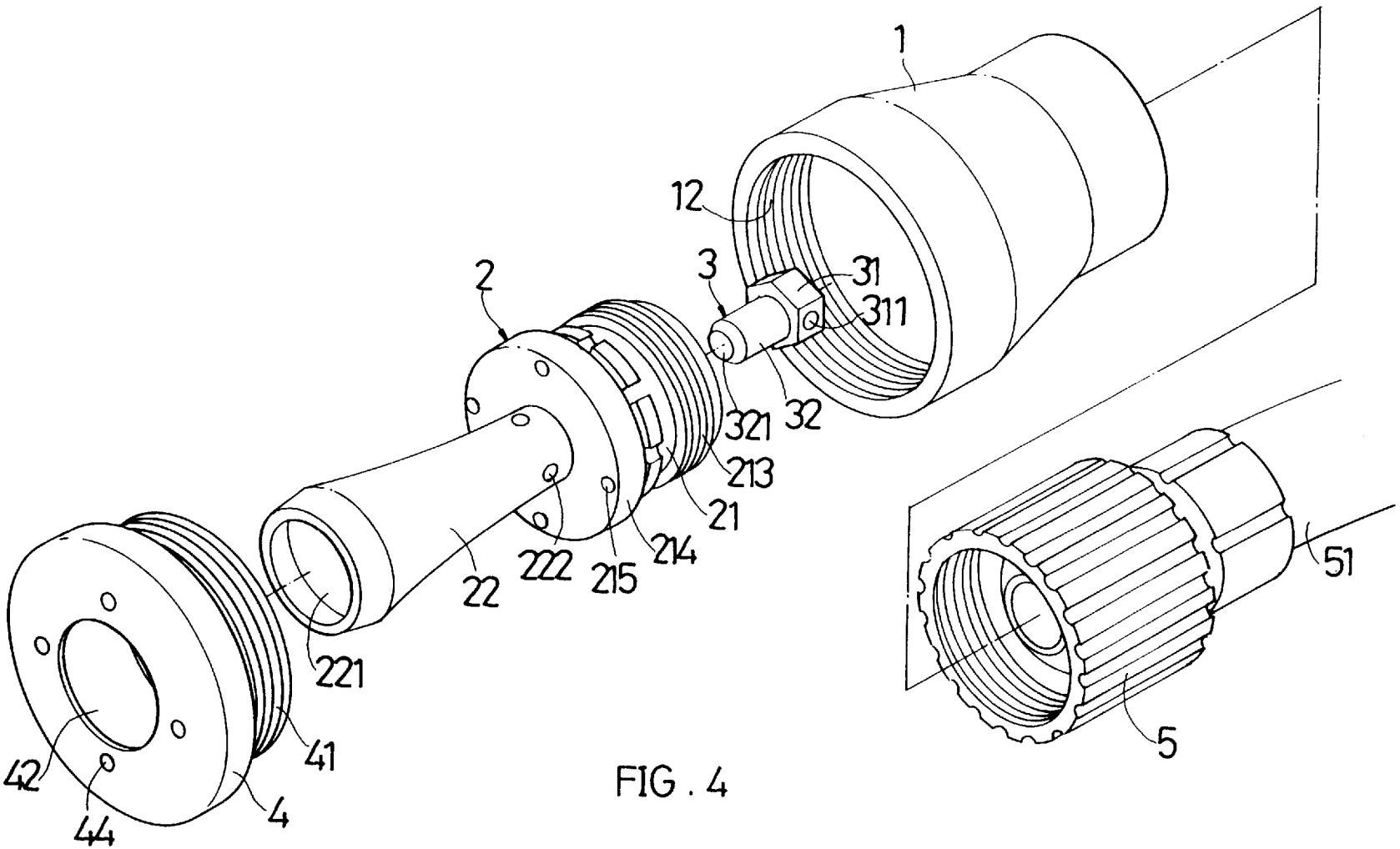
FIG. 4 is a perspective exploded view of a second embodiment of the present invention.

Many modifications of the above embodiment can be made without departing from the spirit of the present invention. For example, with respect to the first embodiment, the air goes through the through holes 43 of the cap member 4 into the air chamber S and further passes through the air vents 222 into the water discharging passage 221. Such air flowing path is relatively long and will result in resonant echo in the air chamber S. Therefore, FIGS. 4 and 5 show a second embodiment of the present invention, which is different from the first embodiment in that the stopper section 214 of the valve seat 2 is disposed with multiple through holes 215 communicating the air chamber S and the ambient atmosphere, while the cap member 4 is formed with blind holes 44 instead of the through holes 43. Accordingly, the distance between the through holes 215 and the air vents 222 is quite short so that the path of the air flow through the air chamber S is shortened to avoid resonant echo.

Figure 6:
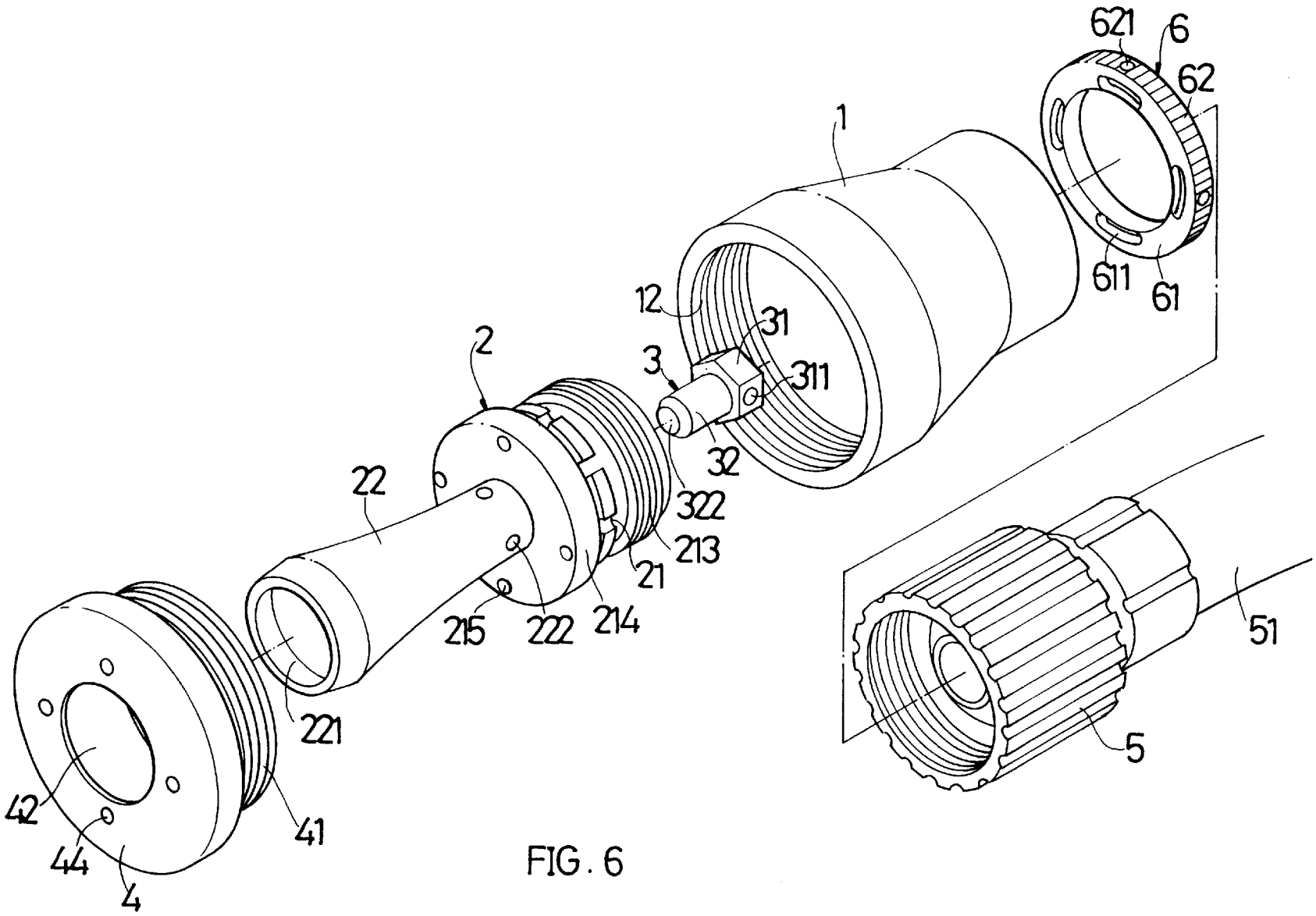
FIG. 6 is a perspective exploded view of a third embodiment of the present invention.
Figure 7:
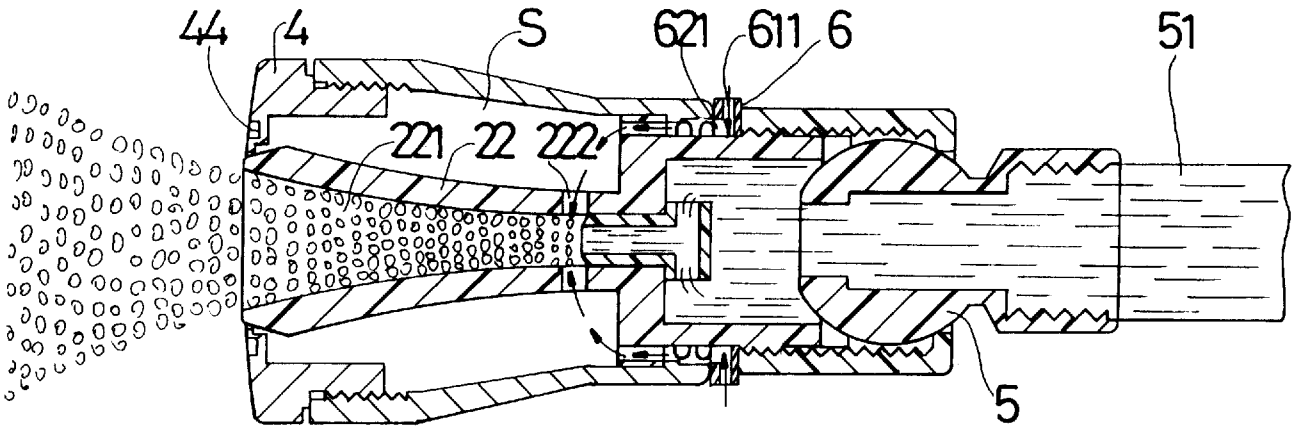
FIG. 7 is a sectional assembled view of the third embodiment of FIG. 6.

FIGS. 6 and 7 show a third embodiment of the present invention, which is derived from the second embodiment. A rotary disk 6 is disposed between outer side of the connecting section 21 of the valve seat 2 and the ball joint 5. The rotary disk 6 has a bottom face 61 contacting with the stopper section of the connecting section 21 and disposed with slots 611 in alignment with the through holes 215. The periphery 62 of the rotary disk 6 is disposed with through holes 621 communicated with the slots 611, whereby by means of rotating the rotary disk 6, the air flow is turned on or cut off so as to control the generation of the intermittent bead-like water beam.

Figure 8:
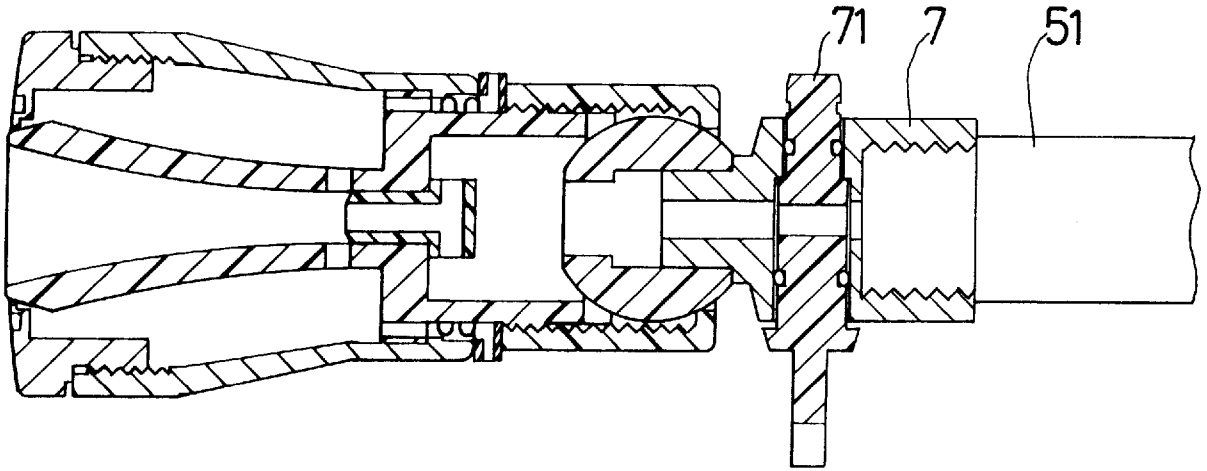
FIG. 8 is a sectional assembled view of a fourth embodiment of the present invention.

FIG. 8 shows a fourth embodiment of the present invention, in which a ball joint 7 having a switch 71 for controlling the flowing the liquid is connected with the connecting section 21 of the valve seat 2 for directly controlling the passing of the liquid.

It is to be understood that the above description and drawings are only used for illustrating some embodiments of the present invention, not intended to limit the scope thereof. Any variation and derivation from the above description and drawings should be included in the scope of the present invention.

What is claimed is:

1. A sprinkling head structure comprising:

a housing which is hollow, having a first and a second open ends, the first end being disposed with an inward extending flange, while the second end being disposed with inner thread;

a valve seat located in the housing and disposed with a connecting section abutting against the flange and extending into the first end of the housing, the connecting section being formed with an opening, the valve seat being further disposed with a spout section axially extending from the connecting section, the connecting section being formed with a shaft hole communicated with an axial trumpet-shaped water discharging passage of the spout section, the connecting section being further formed with outer thread and an annular stopper section abutting against the flange of the housing, an air chamber being defined between the spout section and the housing, the spout section being disposed with air vents communicating the air chamber with the water discharging passage;

a water valve disposed in the shaft hole of the connecting section and formed with internal passages communicated with the water discharging passage of the spout section; and a cap member formed with outer thread screwed in the inner thread of the second end of the housing, the cap member being formed with an axial opening through which the spout section protrudes outside, an end face of the cap member being formed with multiple through holes.

2. A sprinkling head structure as claimed in claim 1, wherein the water discharging passage is gradually expanded from the connecting section so as to form a trumpet-shaped passage.

3. A sprinkling head structure as claimed in claim 1, wherein the connecting section of the valve seat is connected with a ball joint by means of its outer thread.

4. A sprinkling head structure as claimed in claim 1, wherein the water valve has a large diameter section and a small diameter section fitted in the shaft hole of the connecting section, the large diameter section abutting against an end face of the shaft hole, the large diameter section being formed with a radial tunnel communicated with an axial passage of the small diameter section.

5. A sprinkling head structure as claimed in claim 1, wherein the stopper section is formed with multiple through holes communicating the interior of the housing with ambient atmosphere.

6. A sprinkling head structure as claimed in claim 5, wherein a rotary disk is disposed on outer side of the connecting section of the valve seat, the rotary disk having a bottom face contacting with the stopper section of the connecting section and disposed with slots in alignment with the through holes of the stopper section, a periphery of the rotary disk being disposed with through holes communicated with the slots.

* * * * *